United States Patent [19]

Takahashi et al.

[11] Patent Number: 4,917,068

[45] Date of Patent: Apr. 17, 1990

[54] UNIT INJECTOR FOR AN ENGINE

[75] Inventors: Takeshi Takahashi, Mishima; Shinya Hirota; Takashi Yamamoto, both of Susono; Daisaku Sawada, Gotenba; Satoshi Watanabe, Sunto, all of Japan

[73] Assignee: Toyoto Jidosh Kabushiki Kaisha, Japan

[21] Appl. No.: 284,434

[22] Filed: Dec. 14, 1988

[30] Foreign Application Priority Data

Dec. 29, 1987 [JP] Japan ..... 62-335259
Jan. 11, 1988 [JP] Japan ..... 63-2470

[51] Int. Cl.[4] ..... F02M 39/00
[52] U.S. Cl. ..... 123/506; 123/500
[58] Field of Search ..... 123/506, 458, 509, 446, 123/447, 500, 501; 239/88-96

[56] References Cited

U.S. PATENT DOCUMENTS 3,779,225 12/1973 Watson ..... 123/506
4,180,022 12/1979 Tahir ..... 123/498
4,622,942 11/1986 Nozaki et al. .
4,660,523 4/1987 Prauer ..... 123/498
4,721,075 1/1988 Kasai ..... 123/508
4,782,807 11/1988 Takahashi ..... 123/498
4,803,393 2/1989 Takahashi .
4,811,715 3/1989 Djordteuic ..... 123/506

FOREIGN PATENT DOCUMENTS 0151562 8/1985 European Pat. Off. .
3600113 7/1986 Fed. Rep. of Germany .
61-160565 7/1961 Japan .
0003134 1/1987 Japan ..... 123/498
62-64870 4/1987 Japan .
62-64872 4/1987 Japan .

OTHER PUBLICATIONS

SAE paper 850542.
Copending U.S. Patent Application No. 07/073,155 (Filing date: 7/14, 1987),

*Primary Examiner*—Carl Stuart Miller
*Attorney, Agent, or Firm*—Oliff & Berridge

[57] ABSTRACT

A unit injector including a plunger, a high pressure fuel chamber, and a needle, wherein the pressure of fuel in the high pressure fuel chamber is increased by the plunger, a spill valve is slidably inserted in a bore to spill the fuel in the high pressure fuel chamber when a fuel injection is to be stopped, and the slide bore is spaced from and extends in parallel to a line which intersects the common axis of the plunger and the needle at a right angle.

15 Claims, 6 Drawing Sheets

UNIT INJECTOR FOR AN ENGINE

BACKGROUND OF THE INVENTION

1. Field of the Invention

The present invention relates to a unit injector for an engine.

2. Description of the Related Art

Known in the art (see Japanese Unexamined Utility Model Publication (Kokai) No. 62-64872) is a unit injector provided with a plunger which is driven by an engine, a high pressure fuel chamber filled with fuel which is pressurized by the plunger, a needle positioned coaxially with the plunger and moved in accordance with the fuel pressure in the high pressure fuel chamber to open a valve when the fuel pressure exceeds a predetermined pressure, a bore extending between the plunger and needle in a perpendicular direction with respect to the common axis of the same, a spill valve inserted slidably in the bore to control the spillage of fuel in the high pressure fuel chamber, and a piezoelectric element which moves the spill valve axially relative to the bore and controls the opening and closing of the spill valve, wherein the fuel injection is performed when the spill valve is closed.

Further, there is known (See SAE paper No. 850442) a unit injector provided with a plunger which is driven by an engine, a high pressure fuel chamber filled with fuel which is pressurized by the plunger, a needle positioned coaxially with the plunger and moved in accordance with the fuel pressure in the high pressure fuel chamber, to open a valve when the fuel pressure exceeds a predetermined pressure, a bore extending in parallel with and at a distance from the common axis of the plunger and needle, a spill valve slidably inserted in the bore to control the spillage of fuel in the high pressure fuel chamber, and a piezoelectric element positioned axially to the bore and moving the spill valve axially relative to the bore and controlling the opening and closing the spill valve, wherein the fuel injection is performed when the spill valve is closed.

In unit injectors, however, a powerful drive force is applied to the needle since the fuel pressure in the high pressure fuel chamber becomes as a high as 1500 $kg/cm^2$ or more, and as a result, the injector housing between the plunger and needle is subjected to a large compressive load and is distorted. Therefore, as disclosed in Japanese Unexamined Utility Model Publication (Kokai) No. 62-64872, if the bore is formed between the plunger and needle, the powerful drive force applied to the plunger will cause distortion of the bore, with the result that the sliding resistance of the spill valve will be increased and the operating response of the spill valve will be deteriorated, and thus the spill valve will not be fully closed.

Conversely, in the unit injector disclosed in SAE paper No. 850542, the bore is not disposed between the plunger and the needle, and thus the powerful force given to the plunger will not cause a distortion of the bore. But in this unit injector, the bore and the piezoelectric element are disposed coaxially, and further, the bore extends in parallel to the common axis of the plunger and needle, and the length of the fuel spill passage connecting the high pressure fuel chamber and the bore is increased. This fuel spill passage is communicated with the high pressure fuel chamber, and therefore, if the fuel spill passage becomes longer, the volume of the high pressure fuel chamber is increased. If the volume of the high pressure fuel chamber is increased, it is difficult to raise the fuel pressure in the high pressure fuel chamber to a high level, and thus it is difficult to ensure a good atomization of the fuel. Further, when the spill valve is opened to stop the fuel injection, the fuel pressure inside the high pressure fuel chamber will not immediately drop, and thus the fuel injection will continue even after the spill valve is opened. This fuel injection occurring after the spill valve is opened has a poor atomization due to the low fuel injection pressure, and therefore, causes smoke and has an adverse effect on the engine output and the fuel consumption rate.

SUMMARY OF THE INVENTION

An object of the present invention is to provide a unit injector capable of preventing deformation of the bore and maintaining the volume of the high pressure fuel chamber provided with a fuel spill passage at a low value.

According to the present invention, there is provided a unit injector of an engine comprising a housing having a nozzle bore; a plunger movable in the housing and actuated by the engine; a high pressure fuel chamber formed in the housing and defined by the plunger, the pressure of fuel in the high pressure fuel chamber being increased by the plunger; a needle substantially aligned with the plunger in the housing and opening the nozzle bore to inject fuel in the high pressure fuel chamber from the nozzle bore when the pressure of fuel in the high pressure fuel chamber exceeds a predetermined pressure; a fuel spill passage formed in the housing and connected to the high pressure fuel chamber; a spill valve arranged in the fuel spill passage and slidably inserted into a bore formed in the housing, the bore being spaced from and extending in parallel to a line which intersects an axis of the needle at substantially a right angle; and an actuator for actuating the spill valve to open the spill fuel passage when the fuel injection is to be stopped and to close the spill fuel passage when the fuel injection is to be carried out.

The present invention may be more fully understood from the description of a preferred embodiment of the invention set forth below, together with the accompanying drawings.

DESCRIPTION OF A PREFERRED EMBODIMENT

Figure 4:
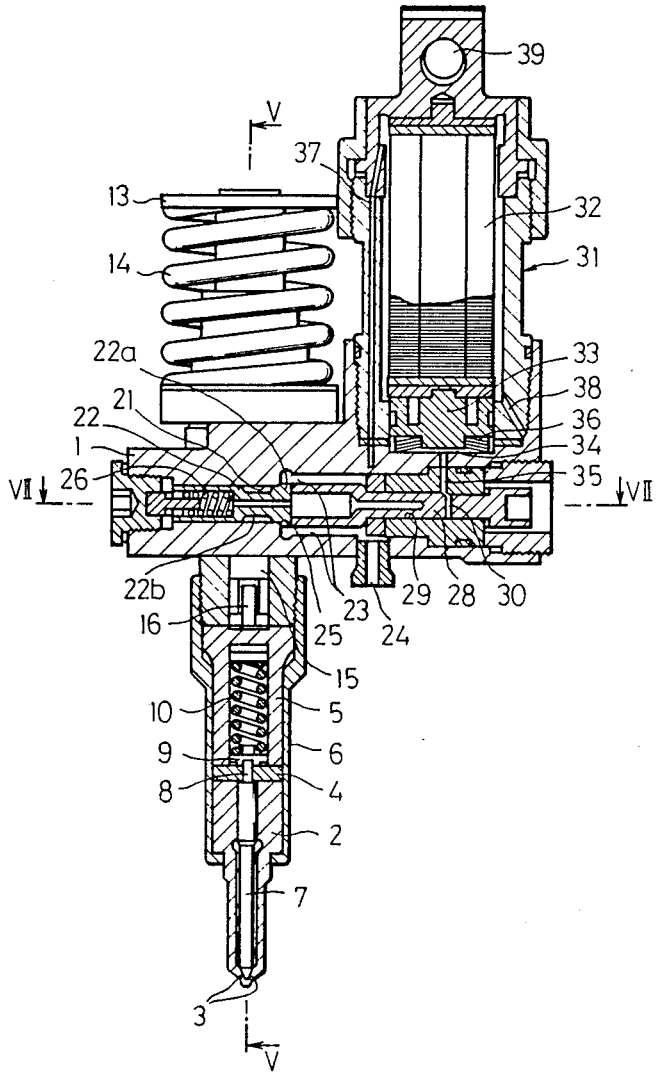
FIG. 4 is a side sectional view of a unit injector taken along the line IV—IV of FIG. 5.
Figure 5:
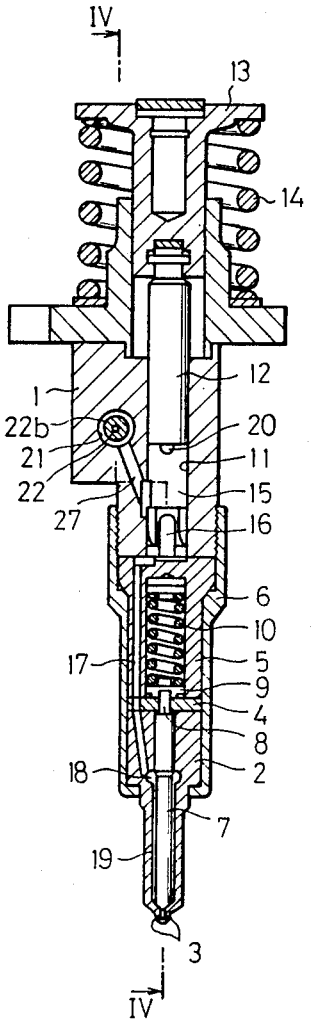
FIG. 5 is a side sectional view taken along the line V—V of FIG. 4.
Figure 6:
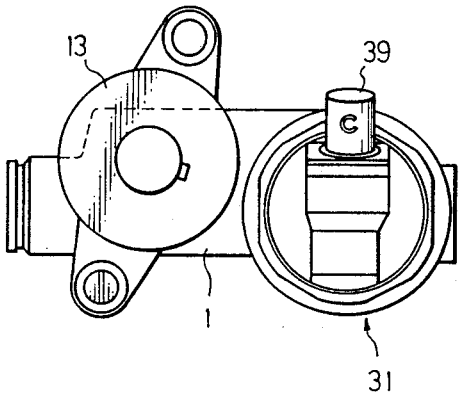
FIG. 6 is a plan view of FIG. 4.

First, an explanation will be made of the structure of the unit injector with reference to FIG. 4 to FIG. 8. As shown in FIG. 4 to FIG. 6, reference numeral 1 indicates the housing body, 2 a nozzle having a nozzle opening 3 at the end portion thereof, 4 a spacer, 5 a sleeve, and 6 a nozzle holder for mounting the nozzle 2, spacer 4, and sleeve 5 to the housing body 1. A needle 7 is slidably inserted in the nozzle 2 and opens and closes the nozzle opening 3. The top of the needle 7 is connected to a spring retainer 9 via a pressure pin 8. The spring retainer 9 is biased downward by a compression spring 10 and this bias force is communicated to the needle 7 through the pressure pin 8. Therefore, the needle 7 is biased to close the valve by the compression spring 10.

On the other hand, a plunger bore 11 is formed in the housing body 1 coaxially with the needle 7, and a plunger 12 is slidably inserted in this plunger bore 11. The top end of the plunger 12 is connected to a tappet 13, which is biased upward by a compression spring 14. This tappet 13 is moved up and down by an engine driven cam and thus the plunger 12 is moved up and down in the plunger bore 11. On the other hand, a high pressure fuel chamber 15 defined by the plunger 12 is formed in the plunger bore 11 under the plunger 12. This high pressure fuel chamber 15 is connected to a pressurized fuel reservoir 18 via a rod filter 16 and a fuel passage 17. The pressurized fuel reservoir 18 is connected to the nozzle opening 3 through an annular fuel passage 19 around the needle 7. Further, a fuel supply port 20 is formed in the wall of the plunger bore 11 and is communicated with the high pressure fuel chamber 15 when the plunger 12 is in the upper position, as shown in FIG. 5. Fuel having a pressure of about 3 $kg/cm^2$ is supplied from the fuel supply port 20 to the high pressure fuel chamber 15.

On the other hand, a bore 21 is formed in the housing body 1 and extended in the horizontal plane near the plunger bore 11. Namely, the bore 21 is formed so that the axis thereof is parallel to and spaced from a line which is substantially at a right angle to a common axis of the plunger 12 and needle 7. A spill valve 22 is slidably inserted in the bore 21. A fuel spill chamber 23 having a diameter larger than that of the bore 21 is formed adjacent to the bore 21, and is supplied with fuel from a fuel supply port 24. The fuel pressure in the fuel spill chamber 23 is maintained at about 3 $kg/cm^2$. The spill valve 22 is provided with an enlarged head portion 22*a* which is arranged in the fuel spill chamber 23 and a circumferential groove 22*b* adjoining the enlarged head portion 22*a*; the enlarged head portion 22*a* controlling the opening and closing of a valve port 25. The spill valve 22 is biased to the right in FIG. 4 by a compression spring 26 arranged opposite to the enlarged head portion 22*a*. Further, a fuel spill passage 27 is formed in the housing body 1 and extended upward radially from the high pressure fuel chamber 15, as shown in FIG. 5. One end of the fuel spill passage 27 is communicated with the high pressure fuel chamber 15, and the other end of the fuel spill passage 27 is communicated with the circumferential groove 22*b* of the spill valve 22.

Also, a rod bore 28 is formed coaxially with the bore 21 in the housing body 1, and has a rod 29 slidably inserted therein. One end of the rod 29 abuts against the enlarged head portion 22*a* of the spill valve 22, and the other end of the rod 29 defines a pressure control chamber 30.

A piezoelectric element housing 31, fastened to the housing body 1, comprises a piezoelectric element 32 formed of a plurality of stacked piezoelectric element plates, and constitutes an actuator. A piston 33 is slidably inserted at the bottom end of the piezoelectric element housing 31, and a cylinder chamber 34 filled with fuel is formed under the piston 33. This cylinder chamber 34 is connected to the pressure control chamber 30 through a fuel passage 35 and contains a flat spring 36 which biases the piston 33 upward. The piezoelectric element 32 is supported between the top of the piezoelectric element housing 31 and the piston 33, with the axis thereof at substantially a right angle to the common axis of the spill valve 22 and rod 29; namely, the axis of the piezoelectric element 32 is substantially parallel to the common axis of the plunger 12 and needle 7. The piezoelectric element housing 31 includes a cooling liquid supply passage 37 and a cooling liquid discharge passage 38 for supplying a cooling liquid, for example, fuel, around the piezoelectric element 32. The cooling liquid, for example, fuel, is supplied at the top of the piezoelectric element 32 from the cooling liquid supply passage 37, descends around and cools the piezoelectric element 32, and is discharged from the cooling liquid discharge passage 38. A plug 39 is mounted at the top of the piezoelectric element housing 31 for supplying power to the piezoelectric element 32.

Figure 7:
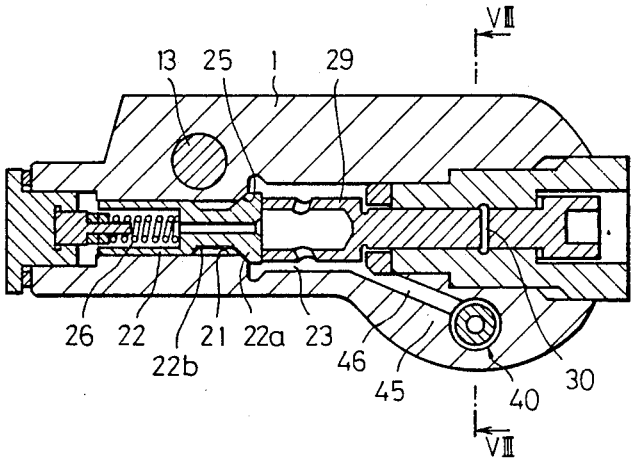
FIG. 7 is a view taken along the line VII—VII of FIG. 4.
Figure 8:
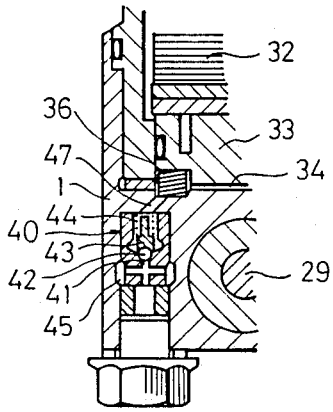
FIG. 8 is sectional view taken along the line VIII—VIII of FIG. 7.

As shown in FIG. 7 and FIG. 8, a check valve 40 is inserted in the housing body 1. This check valve 40 is provided with a ball 42 for opening and closing a valve port 41, a rod 43 for restricting the amount of lift of the ball 42, and a compression spring 44 for biasing the ball 42 and rod 43 downward, and therefore, the valve port 41 is normally closed by the ball 42. The valve port 41 of the check valve 40 is communicated with the fuel spill chamber 23 through an annular fuel inflow passage 45 and fuel inflow passage 46, and a fuel outflow passage 47 of the check valve 40 is connected to the cylinder chamber 34. As mentioned earlier, the fuel pressure in the fuel spill chamber 23 is maintained at about 3 $kg/cm^2$, and when the fuel pressure in the cylinder chamber 34 becomes lower than the fuel pressure in the fuel spill chamber 23, the check valve 40 is opened and additional fuel is supplied to the cylinder chamber 34, and therefore, the cylinder chamber 34 is always filled with fuel.

As mentioned earlier, when the plunger 12 is at the upper position, fuel is supplied to the high pressure fuel chamber 15 from the fuel supply port 20, and therefore, the pressure in the high pressure fuel chamber 15 is about 3 $kg/cm^2$. On the other hand, at this time the piezoelectric element 32 is fully contracted, and thus the fuel pressure in the cylinder chamber 34 and the pressure control chamber 30 is about 3 $kg/cm^2$. Therefore, the spill valve 22 is moved to the right in FIG. 4 by the compression spring 26 and the enlarged head portion 22*a* of the spill valve 22 opens the valve port 25. Accordingly, the fuel pressure in the fuel spill passage 27 and the circumferential groove 22*b* of the spill valve 22 is also about 3 $kg/cm^2$.

When the plunger 12 is moved downward, the fuel supply port 20 is closed by the plunger 12 but the spill valve 22 opens the valve port 25, so that fuel in the high pressure fuel chamber 15 flows out through the fuel spill passage 27, the circumferential groove 22*b* of the spill valve 22, and the valve port 25 to the fuel spill chamber 23. Therefore, the fuel pressure in the high pressure fuel chamber 15 is then about 3 $kg/cm^2$.

When a charge is given to the piezoelectric element 32 to start the fuel injection, the piezoelectric element 32 expands axially, and as a result, the piston 33 is moved downward, and thus the fuel pressure in the cylinder chamber 34 and the pressure control chamber 30 is rapidly increased. When the fuel pressure in the pressure control chamber 30 is increased, the rod 29 is moved to the left in FIG. 4, and therefore, the spill valve 22 is also moved to the left and the enlarged head portion 22*a* of the spill valve 2 closes the valve port 25. When the valve port 25 is closed, the fuel pressure in the high pressure fuel chamber 15 is rapidly increased due to the downward movement of the plunger 12, and when the fuel pressure in the high pressure fuel chamber 15 exceeds a predetermined pressure, for example, 1500 kg/cm$^2$ or more, the needle 7 is opened and fuel is injected from the nozzle opening 3. At this time, a high pressure is also applied to the inside of the circumferential groove 22*b* of the spill valve 22 through the fuel spill passage 27, but the pressure receiving areas of the two axial end surfaces of the circumferential groove 22*b* are equal, and thus a drive force does not act on the spill valve 22.

When the charge of the piezoelectric element 32 is discharged to stop the fuel injection, the piezoelectric element 32 is contracted, and as a result, the piston 33 is moved upward by the flat spring 36, and therefore, the fuel pressure in the cylinder chamber 34 and the pressure control chamber 30 is reduced, and thus the rod 29 and the spill valve 22 are moved to the right in FIG. 4 by the compression spring 26 and the enlarged head portion 22*a* of the spill valve 22 moved to open the valve port 25. As a result, the high pressure fuel in the high pressure fuel chamber 15 flows through the fuel spill passage 27, the circumferential groove 22*b* of the spill valve 22, and the valve port 25 to the fuel spill chamber 23, and accordingly, the fuel pressure inside the high pressure fuel chamber 15 immediately drops to a low pressure of about 3.0 kg/cm$^2$, the needle 7 is moved downward, and the fuel injection is stopped. The plunger 12 is then moved upward to the upper position thereof.

Accordingly, although a powerful downward drive force is applied to the plunger 12 so that the fuel pressure of the high pressure fuel chamber 15 is increased to 1500 kg/cm$^2$ or more, the bore 21 is arranged at the side of the plunger 12 and is not deformed, and thus a smooth sliding action of the spill valve 22 is ensured. Further, the bore 21 is extended horizontally at the side of the plunger 12, and therefore, the bore 21 can be located near the high pressure fuel chamber 15. As a result, the length of the fuel spill passage 27 can be shortened and thus the volume of the high pressure fuel chamber 15, which includes the fuel spill passage 27, can be reduced. Therefore, the fuel pressure in the high pressure fuel chamber 15 is easily increased to a high level, and thus the injected fuel is properly atomized. Further, since the volume of high pressure fuel chamber 15 can be reduced, the fuel pressure in the high pressure fuel chamber 15 is immediately reduced when the spill valve 22 is opened, and thus the fuel injection is immediately stopped. Accordingly, when the spill valve 22 is opened, the fuel injection does not continue under a low pressure, and thus the generation of smoke is suppressed and the engine output and the fuel consumption rate are improved. Moreover, the amount of fuel injection is immediately increased and the fuel injection is immediately stopped by the opening and closing of the spill valve 22, and therefore, a correct pilot injection is made.

Because the bore 21 extends horizontally at the side of the plunger 12, the lateral width of the unit injector can be reduced, and further, by arranging the piezoelectric element 32 so that the axis thereof is substantially at a right angle to the common axis of the bore 21 and rod 29, i.e., substantially at a right angle to the common axis of the plunger 12 and needle 7, the lateral width of the unit injector can be further reduced.

Next, an explanation will be made of the mounting structure of the unit injector shown in FIG. 4 to FIG. 8 with reference to FIG. 1 to FIG. 3.

Figure 1:
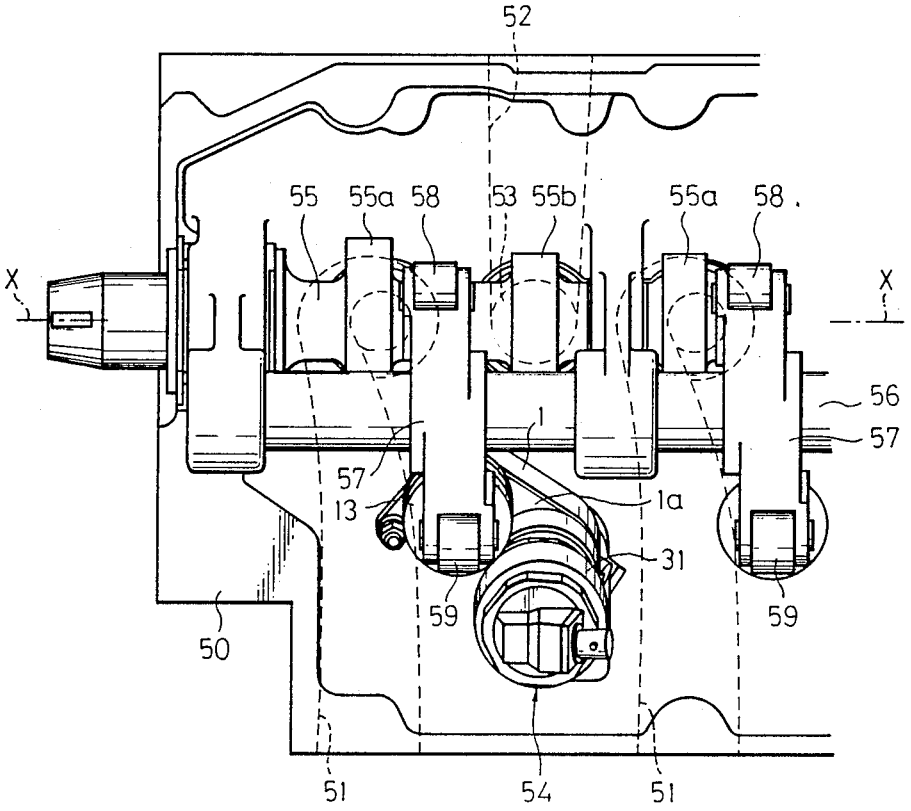
FIG. 1 is plan view of a cylinder head.
Figure 2:
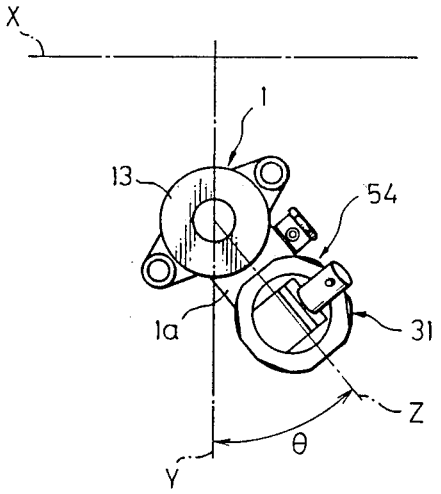
FIG. 2 is a view of a unit injector as seen along the arrow II of FIG. 3.
Figure 3:
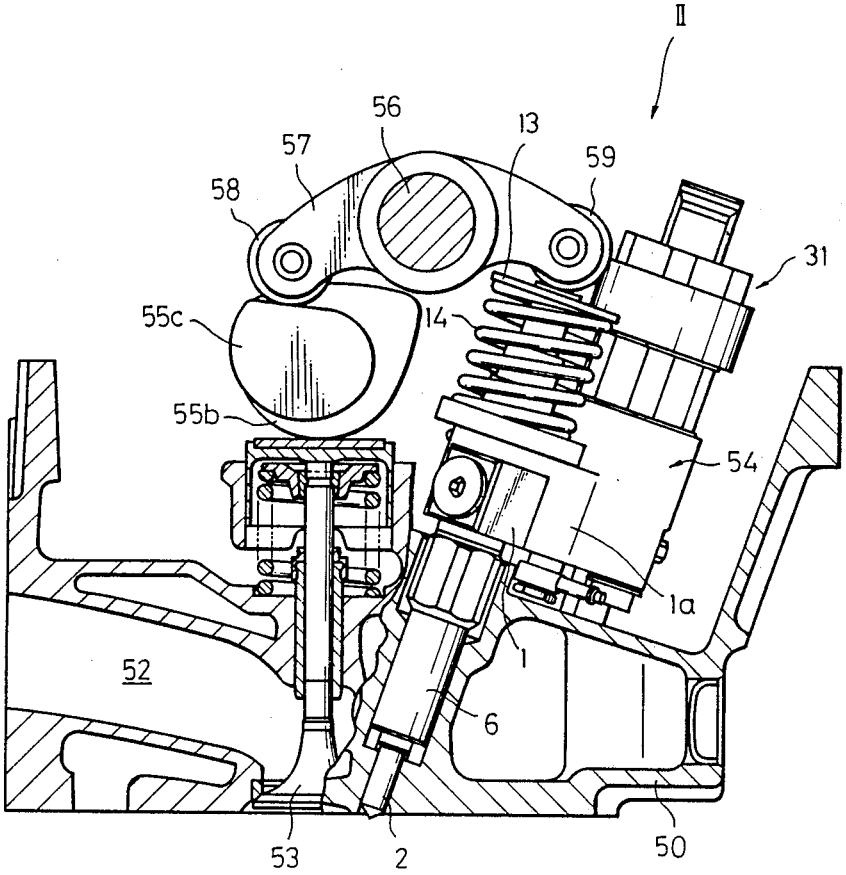
FIG. 3 is a side sectional view of a cylinder head.

Referring to FIG. 1 to FIG. 3, reference numeral 50 is a cylinder head, 51 is a helical type intake port, 52 is an exhaust port, 53 is an exhaust valve, 54 is the unit injector shown in FIG. 4 to FIG. 8, 55 is a cam shaft, 56 is a rocker shaft, and 57 is a rocker arm mounted to the rocker shaft 56. An intake valve drive cam 55*a*, an exhaust valve drive cam 55*b*, and a cam 55*c* which drives the tappet 13 of the unit injector 54, are formed on the cam shaft 55, and at one end of the rocker arm 57, a roller 58 is rotably mounted and rolls on the cam 55*c*. A roller 59 is rotably mounted at the other end of the rocker arm 57 and rolls on the tappet 13.

The cam shaft 55 extends along the longitudinal axis X of the engine, and the common axis of the needle 7 and plunger 12 (FIG. 5) of the unit injector 54 is arranged in the plane Y (FIG. 2) substantially at a right angle to the longitudinal axis X. Further, the line Z which connects the common axis of the needle 7 and plunger 12 and the piezoelectric element 32 or the piezoelectric housing 31 (FIG. 2) is extended obliquely to the plane Y; i.e., the angle formed by the line Z and the plane Y is about 40 degrees in the example shown in FIG. 1 to FIG. 3. Therefore, as shown in FIG. 1, the piezoelectric housing 31 is located at the center of the adjoining intake port 51.

The unit injector 54 comprises the housing body 1, which surrounds the plunger 12 fixed to the cylinder head 50, and thus the piezoelectric element housing 31 is spaced from the fixed position. Therefore, since the weight of the piezoelectric element 32 is considerable, a large stress is created at the housing portion 1*a* extending from this fixed position to the piezoelectric element housing 31. Further, vibration of the engine causes a bending moment and torsion moment to repeatedly act on the housing portion 1*a*. Note, the stress at the housing portion 1*a* is predominantly caused by the bending moment. The vibration of the engine is less in the direction of the longitudinal axis X and greater along the plane Y. Therefore, to reduce the bending moment acting on the housing portion 1*a*, the distance between the piezoelectric element housing 31 and the axis of the needle 7 measured along the plane Y must be reduced. In the example shown in FIG. 2, the piezoelectric element housing 31 is arranged in an oblique direction Z with respect to the axis of the needle 7, whereby the distance between the piezoelectric element housing 31 and the axis of the needle 7 measured along the plane Y is reduced, and therefore, the bending moment acting on the housing portion 1*a* is weaker, and as a result, the stress at the housing portion 1*a* can be reduced and damage thereto prevented. Further, by arranging the piezoelectric element housing 31 in the oblique direction Z with respect to the axis of the needle 7, the piezoelectric element housing 31 can be located between the intake ports 51, where a relatively large margin of space is available.

According to the present invention, the volume of the high pressure fuel chamber including the fuel spill passage can be reduced without deformation of the bore due to the drive force of the plunger.

Although the invention has been described with reference to a specific embodiment chosen for purposes of illustration, it should be apparent that numerous modifications could be made thereto by those skilled in the art without departing from the basic concept and scope of the invention.

We claim:

1. An engine having a unit injector, the unit injector comprising:

a housing having a nozzle bore;

a plunger movable in the housing and actuated by the engine;

a high pressure fuel chamber formed in the housing and defined by the plunger, the pressure of fuel in the high pressure fuel chamber being increased by the plunger;

a needle substantially aligned with the plunger in the housing and opening the nozzle bore to inject fuel in the high pressure fuel chamber from the nozzle bore when the pressure of fuel in the high pressure fuel chamber exceeds a predetermined pressure;

a fuel spill passage formed in the housing and connected to the high pressure fuel chamber;

a spill valve arranged in the fuel spill passage and slidably inserted into a bore formed in the housing, the bore being spaced from and extending in parallel to a line which intersects an axis of the needle substantially at a right angle;

an actuator for actuating the spill valve to open the spill fuel passage when the fuel injection operation is to be stopped and to close the spill fuel passage when the fuel injection operation is to be carried out;

said high pressure fuel chamber being arranged between the plunger and needle and said fuel spill passage extending substantially linearly from said high pressure fuel chamber to the spill valve;

said bore being arranged at the side of said plunger and said fuel spill passage extending obliquely with respect to the axis of the plunger;

said housing having a pressure control chamber formed therein coaxially with the axis of said spill valve, pressure in said pressure control chamber being controlled by said actuator, and said spill valve being controlled by the pressure in said pressure control chamber; and said actuator being spaced from the axis of said needle, the axis of said needle being in a plane which is substantially at a right angle to the longitudinal axis of the engine, and said actuator being positioned obliquely with respect to said plane.

2. A unit injector of an engine comprising:

a housing having a nozzle bore;

a plunger movable in the housing and actuated by the engine;

a high pressure fuel chamber formed in the housing and defined by the plunger, the pressure of fuel in the high pressure fuel chamber being increased by the plunger;

a needle substantially aligned with the plunger in the housing and opening the nozzle bore to inject fuel in the high pressure fuel chamber form the nozzle bore when the pressure of fuel in the high pressure fuel chamber exceeds a predetermined pressure;

a fuel spill passage formed in the housing and connected to the high pressure fuel chamber;

a spill valve arranged in the fuel spill passage and slidably inserted into a bore formed in the housing, the bore being spaced from and extending in parallel to a line which intersects an axis of the needle substantially at a right angle;

an actuator for actuating the spill valve to open the spill fuel passage when the fuel injection operation is to be stopped and to close the spill fuel passage when the fuel injection operation is to be carried out;

said high pressure fuel chamber being arranged between the plunger and needle and said fuel spill passage extending substantially linearly from said high pressure fuel chamber to the spill valve; and said bore being arranged at the side of said plunger and said fuel spill passage extending obliquely with respect to the axis of the plunger.

3. A unit injector according to claim 2, wherein said housing has a pressure control chamber formed therein coaxially with the axis of said spill valve, pressure in said pressure control chamber is controlled by said actuator, and said spill valve is controlled by the pressure in said pressure control chamber.

4. A unit injector according to claim 3, wherein a fuel spill chamber is formed between said spill valve and said pressure control chamber, said bore opens into said fuel spill chamber and has a valve port connected to said high pressure fuel chamber through said fuel spill passage, and said valve port is opened and closed by the spill valve.

5. A unit injector according to claim 4, wherein said spill valve is provided with an enlarged head portion located in said fuel spill chamber for controlling the opening and closing of said valve port and a circumferential groove positioned in said bore and adjacent to said enlarged head portion, said circumferential groove being connected to said high pressure fuel chamber through said fuel spill passage, and said circumferential groove, when said enlarged head portion opens said valve port, is open into said fuel spill chamber.

6. A unit injector according to claim 3, wherein a rod is inserted between said spill valve and said pressure control chamber and the pressure in said pressure control chamber is applied to said spill valve through said rod.

7. A unit injector according to claim 3, wherein said spill valve is spring biased toward said pressure control chamber.

8. A unit injector according to claim 1, wherein said actuator is located nearer to the outside of the engine than to said needle.

9. A unit injector according to claim 3, wherein said actuator is provided with a cylinder chamber having a variable volume and communicated with said pressure control chamber and the pressure of said pressure control chamber is controlled by the pressure in said cylinder chamber.

10. A unit injector according to claim 9, wherein said actuator is composed of a piston which defines the cylinder chamber and a piezoelectric element which drives said piston.

11. A unit injector according to claim 10, wherein said cylinder chamber and said piston are arranged on a common axis and said common axis is substantially parallel to the axis of said needle.

12. A unit injector according to claim 11, wherein said pressure control chamber is arranged on a common axis with said cylinder chamber and said piston.

13. A unit injector according to claim 10, wherein an annular cooling medium passage is formed around said piezoelectric element.

14. A unit injector according to claim 9, wherein said cylinder chamber and said pressure control chamber are filled with fuel.

15. A unit injector according to claim 14, wherein a fuel spill chamber is formed between said spill valve and said pressure control chamber and said fuel spill chamber is connected to said cylinder chamber through a check valve allowing communication only from said fuel spill chamber to said cylinder chamber.

* * * * *

UNITED STATES PATENT AND TRADEMARK OFFICE

CERTIFICATE OF CORRECTION

PATENT NO. : 4,917,068

DATED : April 17, 1990

INVENTOR(S) : Takeshi Takahashi et al.

It is certified that error appears in the above-identified patent and that said Letters Patent is hereby corrected as shown below:

Title page:

Item No. [73] should read as follows:

[73] Assignee: Toyota Jidosha Kabushiki Kaisha, Japan

Signed and Sealed this

Twenty-fifth Day of June, 1991

*Attest:*

*Attesting Officer*

HARRY F. MANBECK, JR.

*Commissioner of Patents and Trademarks*